US007302824B1

(12) United States Patent
Buckler et al.

(10) Patent No.: US 7,302,824 B1
(45) **Date of Patent: *Dec. 4, 2007**

(54) PORTABLE PRESS SYSTEM FOR REPAIRING AUTOMOTIVE COMPONENTS

(76) Inventors: Donald J. Buckler, 1564 N. Deerpath Trail, Franktown, CO (US) 80116; Randy W. Garmon, 7355 Braun Way, Arvada, CO (US) 80005

( * ) Notice: Subject to any disclaimer, the term of this patent is extended or adjusted under 35 U.S.C. 154(b) by 0 days.

This patent is subject to a terminal disclaimer.

(21) Appl. No.: 11/530,876

(22) Filed: Sep. 11, 2006

Related U.S. Application Data

(63) Continuation of application No. 10/710,605, filed on Jul. 23, 2004, now Pat. No. 7,104,107.

(60) Provisional application No. 60/489,869, filed on Jul. 24, 2003.

(51) Int. Cl.
*B21J 13/00* (2006.01)
*B21D 26/00* (2006.01)
*B21C 1/00* (2006.01)

(52) U.S. Cl. ..... 72/447; 72/466.8; 72/705

(58) Field of Classification Search ..... 72/705, 72/447, 457, 413, 414, 466.8; 29/251
See application file for complete search history.

(56) References Cited

U.S. PATENT DOCUMENTS

| | | | | |
|---|---|---|---|---|
| 2,717,020 | A * | 9/1955 | Dobias | 72/394 |
| 2,788,831 | A * | 4/1957 | Weiner | 72/415 |
| 3,776,019 | A * | 12/1973 | Shaw | 72/404 |
| 4,158,303 | A * | 6/1979 | Horn et al. | 72/457 |

* cited by examiner

*Primary Examiner*—Derris H. Banks
*Assistant Examiner*—Teresa M. Bonk
(74) *Attorney, Agent, or Firm*—Glenn L. Webb

(57) ABSTRACT

A system for pushing or punching out deformations in automotive components. The system consists of a support frame, a top rail on a support frame, a hydraulic press that may be suspended at any point along the top rail of a support frame, a mounting surface and a tool head assembly for attaching to the hydraulic press. The system provides a press assembly that is portable and allows quick and easy repair of a damaged automotive component. The system provides the user with increased flexibility to modify the position and alignment of the tool assembly for positioning at the center of the deformation and thereby increasing the accuracy with which a user may restore the original shape of the automotive component.

11 Claims, 6 Drawing Sheets

PORTABLE PRESS SYSTEM FOR REPAIRING AUTOMOTIVE COMPONENTS

This application is a continuation of Ser. No. 10/710,605, filed on Jul. 23, 2004 now U.S. Pat. No. 7,104,107 relates to the subject matter of provisional application 60/489,869, filed on Jul. 24, 2003.

BACKGROUND OF INVENTION

Dents in automotive bumpers occur frequently as the bumper is designed to be the first part of the vehicle to come into contact with another object, thereby preventing further damage to the rest of the automobile. Most automotive bumpers are formed of a flexible yet durable material that can withstand minor speed impacts, but are typically deformed or dented by coming into contact with another object when the vehicle is moving at a speed as low as 5 miles per hour. A variety of different objects, including non-stationary objects such as trash cans may cause a deformation in a bumper. Repair of even minor dents in a bumper can often exceed several hundreds of dollars and cause the vehicle to be unavailable for use for many hours, and possibly even for days until the repair can be completed.

Techniques for repairing dents in automobile bumpers range from banging the dent out with a hammer to using sophisticated metal shop presses. Due to the expense associated with the current press systems, the preferred method of repairing dents in automobile bumpers is to use a hand-held tool and provide manual force to reshape the bumper into its original contour. This method however is difficult to perfect and perform consistently. It also often requires repainting of the entire bumper due to the flaking and chipping that occurs as the hammer strikes the bumper material.

Some systems have been proposed that try to overcome these disadvantages. One such system is disclosed in U.S. Pat. No. 6,089,075. This system, however, still requires manual force to reshape the bumper. The system also requires that the bumper still be attached to the vehicle in order to provide the complementary force required to pull the dented portion of the bumper back into its original shape.

Another such system is disclosed in U.S. Pat. No. 6,014,885. This system uses a combination anvil and impact head powered by a motor disposed within a common housing. The disadvantages of this system include the likelihood of abrasion to the outer surface of the bumper caused by contact with the impact head, as well as the difficulty of positioning the two elongated arms beneath the vehicle in order to reach the desired location on the bumper. This system also requires that the bumper be secured to another object to prevent the bumper from moving while engaging with the anvil head.

Another system is disclosed in U.S. Pat. No. 6,543,270, which provides multiple tools and tips for mounting on said tools to repair dents in automobile body parts. This system also has the disadvantage of requiring manual force to repair the dent, and requires some skill in selecting the appropriate tip for the type of dent to be repaired. None of the prior art systems teaches a reliable and repeatable method of repairing dents in automobile bumpers.

It is therefore desirable to provide a portable press assembly that allows quick and easy repair of a bumper while detached from the vehicle. It is desirable to provide the user with increased flexibility to modify the position and alignment of a tool assembly for positioning at the center of the deformation and thereby increasing the accuracy with which a user may restore the original shape of the bumper.

SUMMARY OF INVENTION

The present invention solves these problems and others by providing a system for pushing or punching out deformations in automotive bumpers while removed from the vehicle body. The system consists of a support frame with a pivotable top rail, a hydraulic press that may be suspended at any point along the top rail of the support frame, a bumper mounting surface and a tool head assembly for attaching to the hydraulic press.

In a preferred embodiment of the invention a support frame includes a top rail pivotably mounted on a vertical support post. The top rail may be secured to an opposing side post or else pivoted out over the support table as necessary. A hydraulic assembly, which includes a hydraulic press, is slidably mounted on the top rail. The top rail has a continuous horizontal chamber, which allows the assembly to be placed therein. The assembly includes a lip of shelf element that retains the equipment against the top rail. A power unit supplies hydraulic pressure to a ram cylinder, and controls may be mounted adjacent the assembly or on the power unit. In this preferred embodiment the support frame is mountable in the bed of a pickup truck or similarly equipped vehicle.

As discussed in greater detail below, the system includes a plurality of tool heads of differing shapes and designs in order to accommodate different types of bumpers as well different sizes and placements of dents to be removed. In a preferred embodiment the system may be accompanied by a variety of tool heads in order to accommodate remote repairs, including at the site of an accident, at a body shop or at the damaged vehicle owner's home.

In an alternate embodiment of the invention the assembly and support frame may be located apart from a vehicle in a body shop or other fixed location where repairs may be performed.

For a fuller understanding of the nature and advantages of the invention, reference should be made to the ensuing detailed description taken in conjunction with the accompanying drawings.

DETAILED DESCRIPTION

The present invention provides a solution to the repair of dents in metallic automotive bumpers. It is to be expressly understood that this descriptive embodiment is provided for explanatory purposes only, and is not meant to unduly limit the scope of the present invention. Other embodiments of the present invention are considered to be within the scope of the claimed inventions, including not only those embodiments that would be within the scope of one skilled in the art, but also as encompassed in technology developed in the future. For example, and not to limit the scope of the present invention, the system may also be adapted for use with other automotive body parts, such as doors, door frames, fenders, hoods, panels etc. as well as other structural components both automotive and non-automotive.

Figure 1:
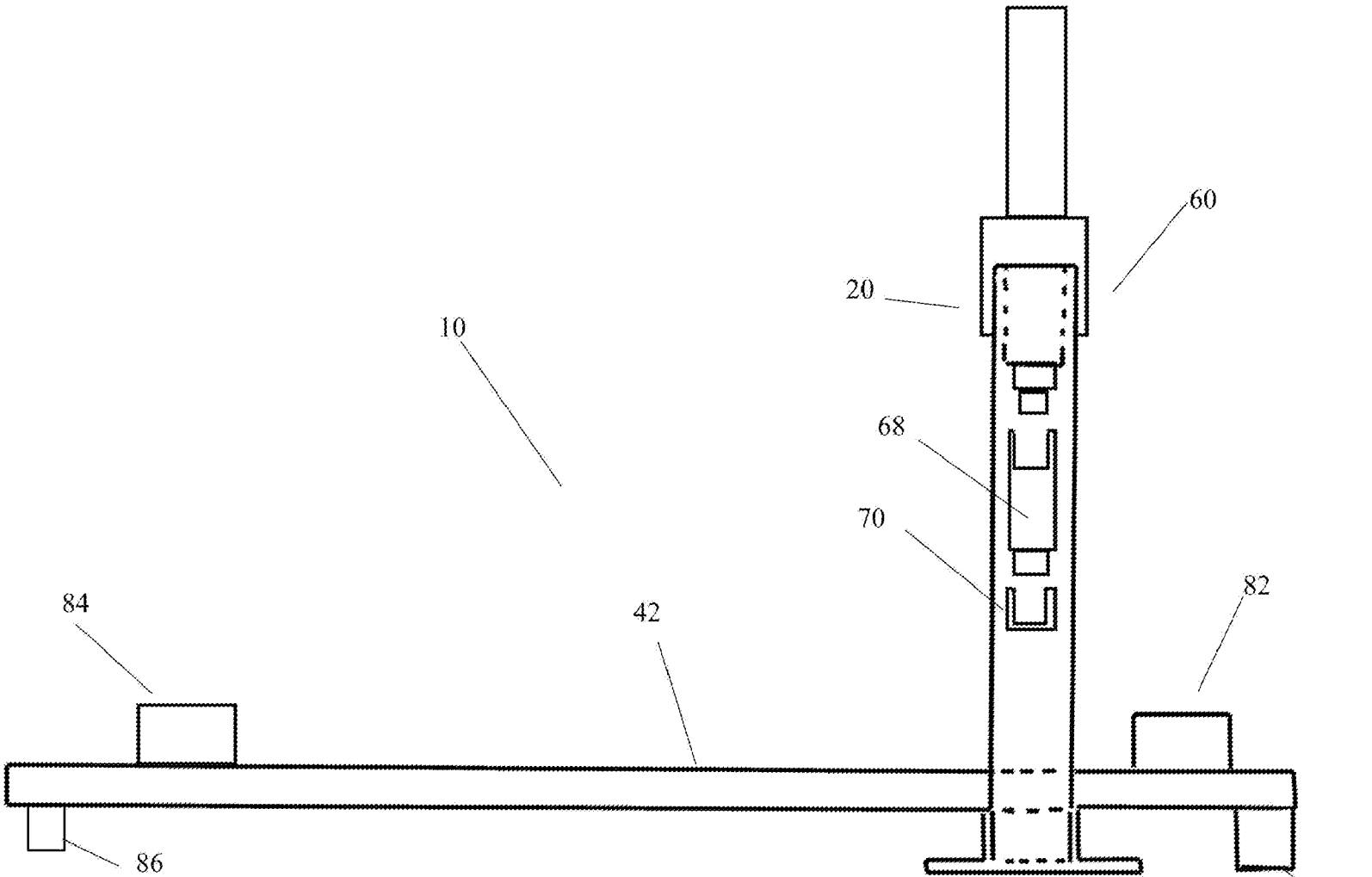
FIG. 1 is a profile view of the press system in a preferred embodiment.
Figure 6:
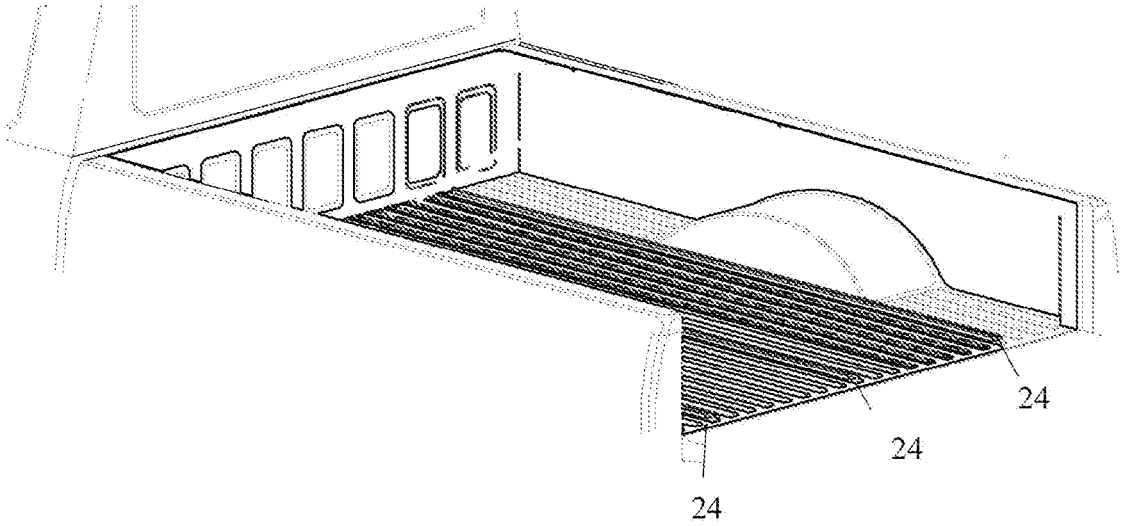
FIG. 6 is a perspective view of the rail mounting system for mounting the system in a vehicle cargo bed.
Figure 7:
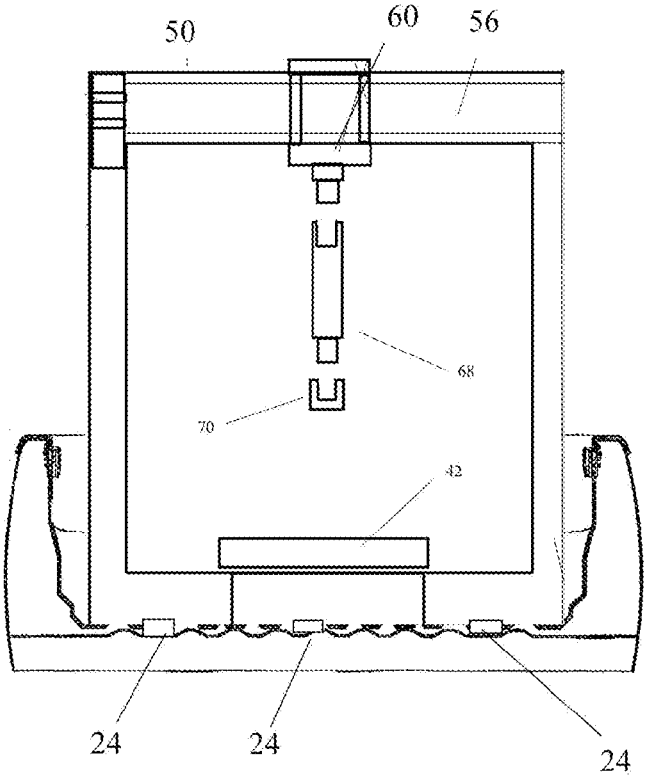
FIG. 7 is a front view of the system of a preferred embodiment mounted in a vehicle cargo bed.

A preferred embodiment of the present invention is illustrated in FIG. 1. The system 10 of this preferred embodiment includes a portable hydraulic press 20. The portable hydraulic press 20 is designed to be transported in the back of a half ton pick up truck, or mounted on rails 24 as shown in FIG. 6 and FIG. 7 to slide out from a truck or utility van. The system 10 includes a bottom rail 30 and side rails (not shown). A mounting table 42 is movably mounted on the bottom rail 30. The mounting table 42 may be secured flat on the bottom rail 30, supported by support elements as discussed below, or moved along the bottom rail 30 to a desired position and either secured there or allowed to remain unsecured during operation. In this descriptive embodiment, the mounting table 42 is designed to hold most automotive bumpers.

In another preferred embodiment, the mounting table 42 may have a particular configuration designed to match the shape of the bumper being repaired. This would be limited to those instances where a particular bumper shape is often repaired.

Figure 2:
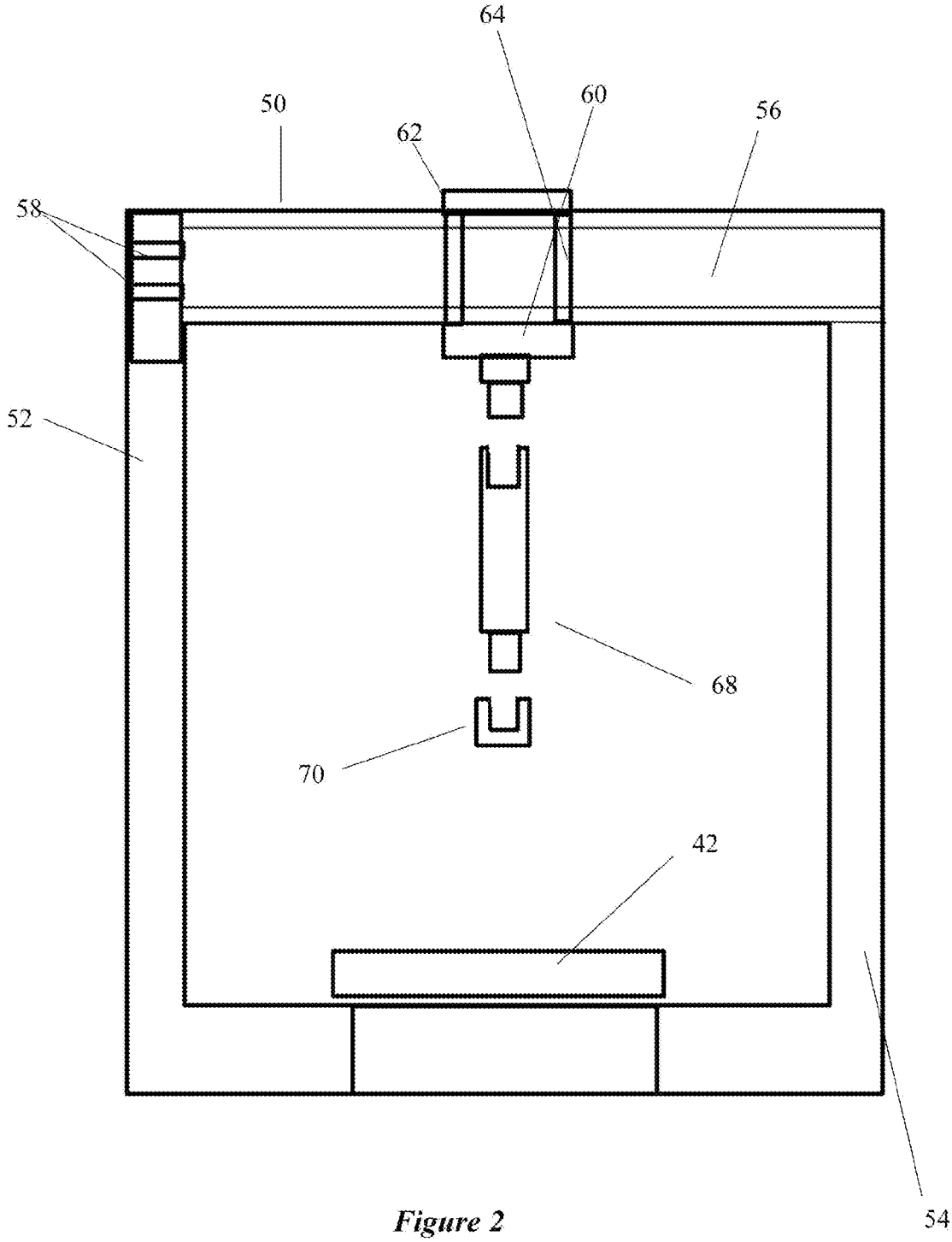
FIG. 2 is a cross-sectional view of the press system of FIG. 1.
Figure 3:
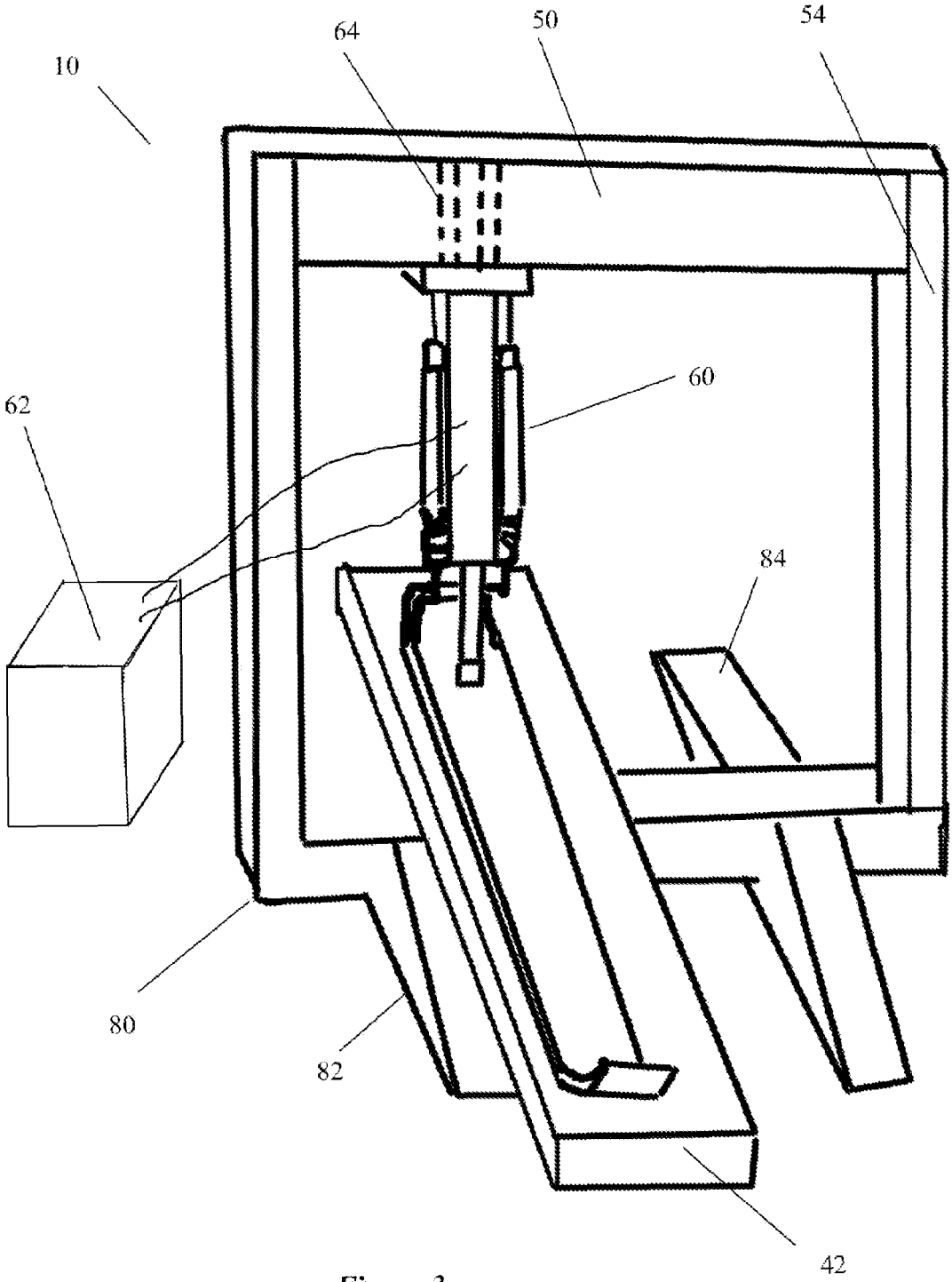
FIG. 3 is a perspective view of a bumper being repaired using the press system of FIG. 1.

Referring in detail to FIG. 2, a top rail 50 is pivotably mounted on support post 52. The pivoting support may include bearings 58, bushings or other mechanisms allowing pivotable rotation of the top rail 50 relative to the support post. In another preferred embodiment, the top rail 50 is secured for non-pivoting motion relative to the support post 50.

In the preferred embodiment, the top rail 50 may be secured to side post 54 or else pivoted out over the mounting table 42 as necessary if necessary to repair the bumper. A hydraulic assembly 60 is slidably mounted on top rail 50. The assembly 60 may be secured once it has moved to a desired position relative to the top rail 50 by a pair of U brackets, detent pins, bolts or any other type of securing mechanism 64.

The assembly 60 includes a hydraulic press, including commercially available hydraulic presses or custom built hydraulic presses. A power unit 62 supplies the hydraulic pressure to the assembly ram cylinder (not shown). This power unit may be contained integrally with the unit 10 or a separate power unit mounted on the vehicle. The system may also utilize pneumatic power, fluid power, electrical units or any other type of power unit to operate the assembly ram. Controls may be mounted adjacent the assembly 60 or on the power unit.

Figure 5:
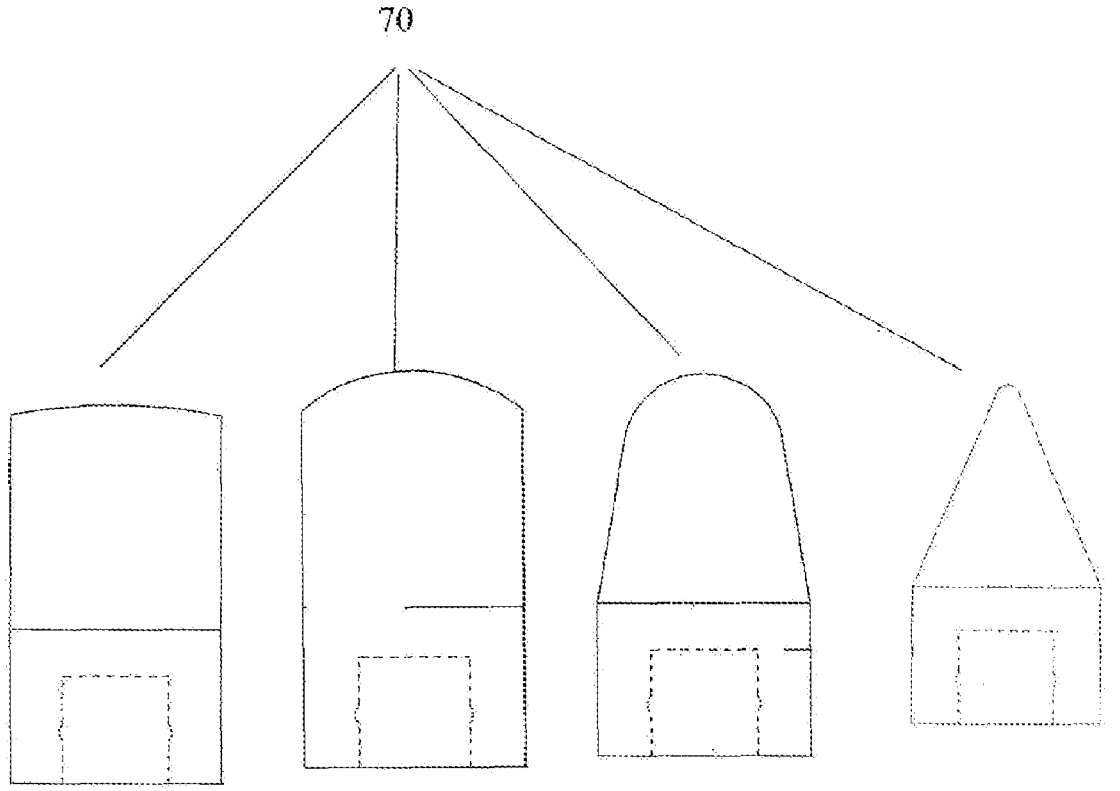
FIG. 5 is front view of an example of a plurality of tool heads.

The lower portion 68 of the hydraulic assembly 60 includes a system for replacing tool heads 70. As discussed in greater detail below, the system 10 includes a plurality of tool heads 70 as shown in FIG. 5 of differing shapes and designs in order to accommodate different types of bumpers as well different sizes and placements of dents to be removed.

In use, the system 10 can be located at fixed location, such as automotive body shop, or a mobile system that is brought to the work site. The bumper is removed from the vehicle, and placed on the mounting table 42 so that the tool head 70 is directly above the dent to be repaired. If necessary, the top rail 50 may be pivoted over the dent in the bumper.

An appropriate tool head 70 is selected depending on the bumper, the dent and the location of the dent. The appropriate tool head 70 is chosen for the size, location and bumper style and mounted on the assembly 60. For example, the tool head 70 may include an offset center in order to allow the tool head to fit underneath the lip of a bumper. Other tool heads may be curved or angled to match the shape of the bumper, or other shapes or sizes. The tool heads 70 are designed to localize the pressure against the inner surface of the dent to be repaired.

The system in one preferred embodiment includes a pair of leveling elements 82, 84 positioned along the lower rail 80 to prevent the system 10 from moving during the repair and to stabilize the assembly. Also, the bumper may be leveled relative to the tool head 70. The system includes a plurality of different sizes and shapes of leveling blocks 86. Appropriately sized leveling block(s) are selected and slipped under the free end of the bumper and/or the mounting table 42 to achieve correct positioning relative to the assembly 60.

Once the tool head 70 has been selected and secured to the assembly 60, the assembly 60 is placed under power. Pressure is supplied to the hydraulic assembly 60 causing it to press downwardly against the dent in the bumper. Once the dent has been pressed flush, the pressure is released and the ram and tool head move upwardly out of the way. The bumper is then remounted onto the vehicle.

Figure 4:
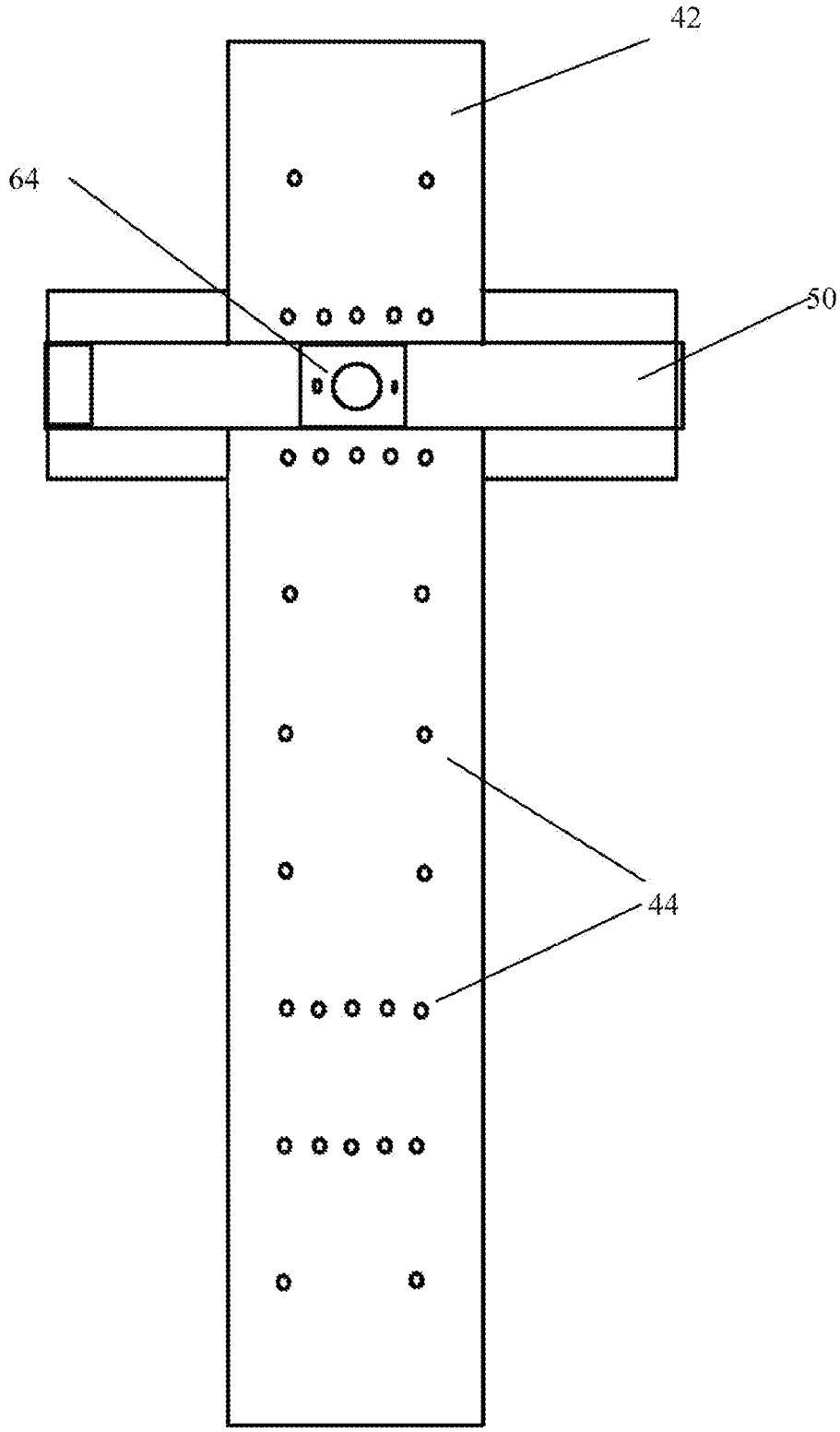
FIG. 4 is a detailed view of the mounting table of FIGS. 1 and 22.

Referring in detail now to FIG. 4, in a preferred embodiment of the present invention, the mounting table 42 is formed from plastic, such as polyvinyl chloride (PVC). It is to be expressly understood that other materials may be used as well, including plastics, rubber, wood or metal. It is adjustable on the bottom rail 30 of the support frame and, preferably, will not scratch or damage the bumper being repaired. The mounting table 42 includes a plurality of predrilled holes 44 for use with pins (not shown) in order to maintain the desired position of the bumper relative to the mounting table 42. Also, clamps may be used to hold the bumper relative to the mounting table 42 during the operation of the assembly.

In an alternative embodiment, the bottom rail 30 is omitted, and the mounting table is placed directly on the ground surface.

It is to be expressly understood that the above descriptive embodiment is intended for explanatory purposes only. Other embodiments are included in the present invention, including but not limited to configurations for pressing out dents in structural components of automotive and non-automotive structures, body dents, container dents and other dented or bent structures.

What is claimed is:

1. A system for repairing dents in automotive components, comprised of:

a portable support frame for transport to a jobsite;

a mounting table having a mounting surface affixed to said portable support frame for supporting an automotive component;

an adjustable positioning mechanism on said mounting surface for supporting an automotive component in the appropriate position on said mounting table;

a top rail mounted on said portable support frame;

a press suspended from said portable support frame on said top rail; and a tool head attachable to said press for holding at least one tool for pressing dents out of an automotive component;

whereby an automotive component may be positioned relative to said mounting surface below said press so said tool head presses a deformation smooth on an automotive component.

2. The system of claim 1 wherein said system includes:

a hydraulic power supply to operate said press.

3. The system of claim 1 wherein said system includes:

a pneumatic supply to operate said press.

4. The system of claim 1 wherein said system includes:

a pivotable mechanism for supporting said top rail for pivoting movement relative to said support frame.

5. The system of claim 1 wherein said system includes:

a plurality of holes formed in said mounting surface; and said positioning mechanism utilizes said plurality of holes for controlling the position of a automotive component.

6. The system of claim 1 wherein said system further includes:

a mounting mechanism mounting said top rail to said support frame for allowing said press to move relative to said support frame.

7. The system of claim 1 wherein said system further includes:

a mounting mechanism for mounting said press on said top rail and allowing said press to adjustably move relative to said top rail.

8. The system of claim 1 wherein said system includes:

a mounting mechanism for mounting said system in the bed of a truck.

9. The system of claim 1 wherein said support frame includes:

a bottom rail upon which said mounting table may be removably positioned thereon.

10. The system of claim 9 wherein said bottom rail further comprises:

at least one leveling element substantially perpendicular to said bottom rail to stabilize said system.

11. The system of claim 1 wherein said system includes:

a plurality of said tool heads; and each of said tool heads having a differing configuration to press deformations in a automotive component depending on the size, location and style of the automotive component.

* * * * *